US005664548A

United States Patent [19]

Izutani et al.

[11] Patent Number: 5,664,548

[45] Date of Patent: Sep. 9, 1997

[54] APPARATUS FOR DETECTING TROUBLE IN EXHAUST-GAS RECIRCULATION SYSTEM

[75] Inventors: Takahide Izutani; Hidemi Onaka; Koji Morita, all of Susono, Japan

[73] Assignee: Toyota Jidosha Kabushiki Kaisha, Aichi, Japan

[21] Appl. No.: 628,225

[22] Filed: Apr. 4, 1996

[30] Foreign Application Priority Data

Apr. 12, 1995 [JP] Japan ..... 7-086796

[51] Int. Cl.[6] ..... F02M 25/07

[52] U.S. Cl. ..... 123/571; 73/117.3

[58] Field of Search ..... 123/568, 569, 123/571, 676; 73/117.3, 118.1, 116, 118.2; 364/431.06

[56] References Cited

U.S. PATENT DOCUMENTS

| | | | |
|---|---|---|---|
| 3,794,006 | 2/1974 | Woodward | 123/198 D |
| 4,195,531 | 4/1980 | Okamura | 123/571 |
| 4,428,355 | 1/1984 | Yokooku | 123/571 |
| 4,448,177 | 5/1984 | Hasegawa et al. | 123/571 |
| 4,541,398 | 9/1985 | Kishi | 123/571 |
| 5,257,610 | 11/1993 | Ohuchi | 123/571 |
| 5,337,725 | 8/1994 | Narita | 123/571 |
| 5,508,926 | 4/1996 | Wade | 123/571 |
| 5,577,484 | 11/1996 | Izutani et al. | 123/571 |

FOREIGN PATENT DOCUMENTS

| | | |
|---|---|---|
| 60-256546 | 12/1985 | Japan . |
| 63-75345 | 4/1988 | Japan . |

*Primary Examiner*—Willis R. Wolfe
*Attorney, Agent, or Firm*—Kenyon & Kenyon

[57] ABSTRACT

A trouble-detection apparatus for an EGR system provided with an EGR control valve in an EGR passage, capable of correctly detecting a position in the EGR passage at which the clogging has occurred. The trouble-detection apparatus is applied to the system having the EGR control valve controlled by a negative pressure in the EGR passage wherein a lift amount of the EGR control valve is controlled by a lift sensor in a feedback manner in accordance with the operating state of the engine. According to the trouble-detection apparatus, the amplitude of the lift amount detected by the lift sensor is obtained and the pulses in the exhaust-gas flow are calculated from the detected amplitude. When the amplitude of the pulses in the exhaust-gas flow does not reach a threshold value preset in accordance with the operating state of the internal combustion engine, it is determined that clogging as occurred in the EGR passage. In such a case, it is also possible to determine whether or not the clogging has occurred in the EGR passage by dividing the lift amount detected by the lift sensor into two subsystems, extracting solely a pulse component therefrom, calculating an amplitude of the extracted pulse component, and comparing the calculated amplitude with a threshold value.

14 Claims, 8 Drawing Sheets

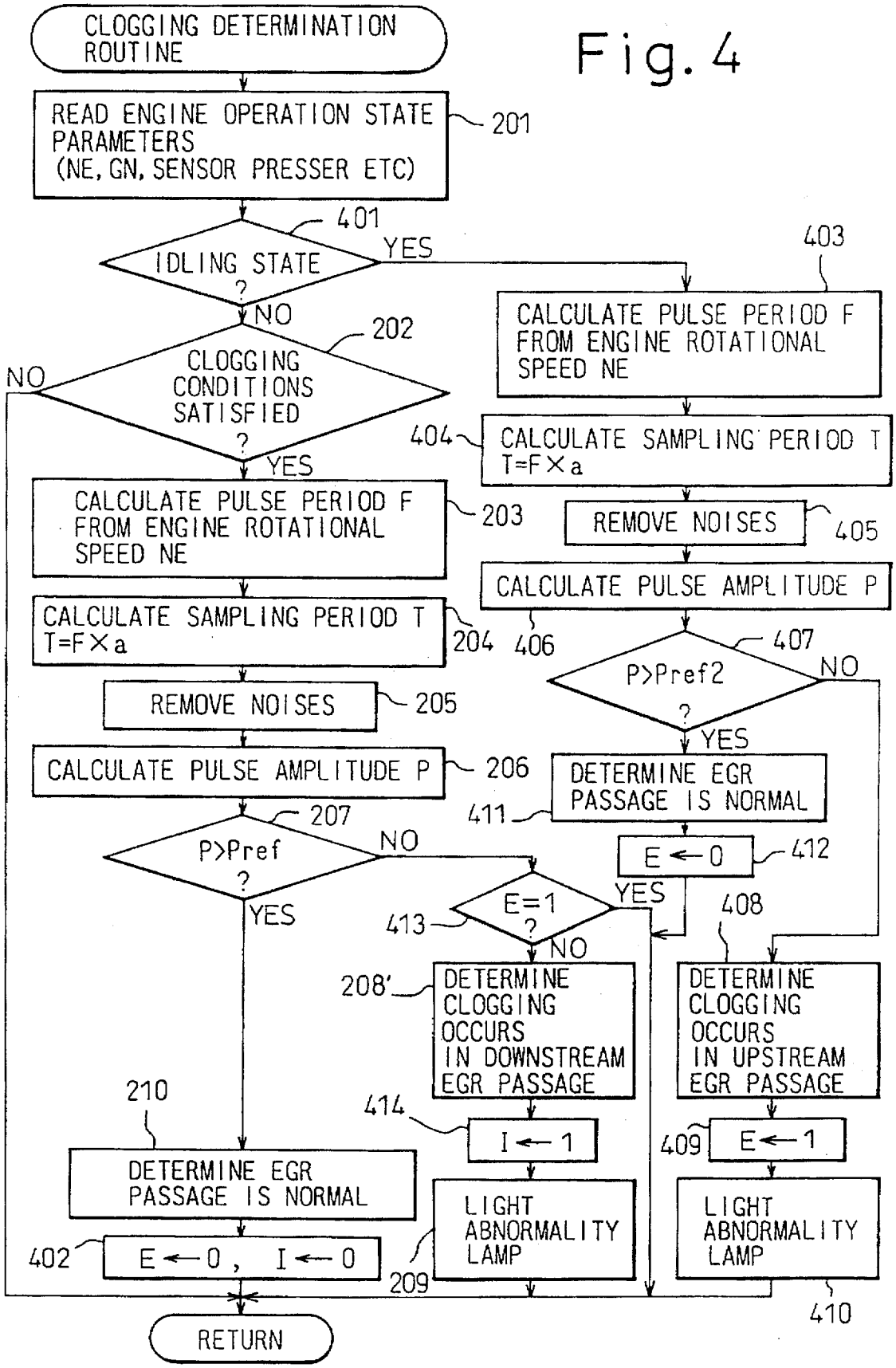
CLOGGING DETERMINATION ROUTINE
Fig. 4
READ ENGINE OPERATION STATE PARAMETERS (NE, GN, SENSOR PRESSER ETC)
201
401
IDLING STATE ?
YES
NO
403
CALCULATE PULSE PERIOD F FROM ENGINE ROTATIONAL SPEED NE
202
CLOGGING CONDITIONS SATISFIED ?
NO
YES
404
CALCULATE SAMPLING PERIOD T T=F×a
CALCULATE PULSE PERIOD F FROM ENGINE ROTATIONAL SPEED NE
203
REMOVE NOISES
405
CALCULATE PULSE AMPLITUDE P
CALCULATE SAMPLING PERIOD T T=F×a
204
406
407
P>Pref2 ?
NO
REMOVE NOISES
205
YES
CALCULATE PULSE AMPLITUDE P
206
DETERMINE EGR PASSAGE IS NORMAL
411
207
P>Pref ?
NO
E←0
412
YES
E=1 ?
YES
413
408
NO
208'
DETERMINE CLOGGING OCCURS IN DOWNSTREAM EGR PASSAGE
DETERMINE CLOGGING OCCURS IN UPSTREAM EGR PASSAGE
210
414
I←1
409
E←1
DETERMINE EGR PASSAGE IS NORMAL
LIGHT ABNORMALITY LAMP
LIGHT ABNORMALITY LAMP
402
E←0, I←0
209
410
RETURN

APPARATUS FOR DETECTING TROUBLE IN EXHAUST-GAS RECIRCULATION SYSTEM

BACKGROUND OF THE INVENTION

1. Field of the Invention

The present invention relates to an apparatus for detecting trouble in an exhaust-gas recirculation (hereinafter referred to as "EGR") system of an internal combustion engine, particularly to an apparatus capable of detecting clogging occurred in the EGR passage provided with an EGR control valve. More specifically, it relates to an apparatus for detecting trouble in the EGR system, capable of discriminating whether clogging has occurred on the upstream side or on the downstream side of the EGR control valve.

2. Description of the Related Art

To reduce an amount of NOx in an exhaust gas, an EGR system, as is well known, wherein the exhaust gas flowing through an exhaust passage is recirculated to an intake passage of an internal combustion engine via an EGR passage, is used. In the EGR system of such a type, an EGR control valve is usually provided in the EGR passage. The amount of EGR gas to be supplied to the intake passage of the internal combustion engine is controlled by the opening degree of the EGR control valve. However, the recirculation of exhaust gas may be continuously interrupted if the EGR control valve is broken or the EGR passage clogs. If such an inconvenience is left as it is a large amount of NOx is continuously discharged because no EGR is conducted. In addition, the reduction of the amount of recirculating exhaust gas or the interruption of EGR due to the trouble in the EGR system is seldom found by the driver.

To solve such a problem, apparatuses for diagnosing trouble in the EGR system have been proposed wherein the opening degree of EGR control valve is controlled by the magnitude of a negative pressure introduced into a diaphragm chamber in the EGR control valve partitioned by a diaphragm. For example, Japanese Unexamined Patent Publication (Kokai) No. 63-75345 discloses an apparatus diagnosing the trouble of EGR system of a diaphragm type comprising a pressure detection means provided upstream of EGR control valve and means for detecting the supply of negative pressure to the EGR control valve. According to the trouble detection apparatus disclosed in the above Patent Publication, "trouble" is determined if no flow of exhaust gas is detected by the pressure detection means when a negative pressure is supplied to the EGR control valve. Contrarily, "trouble" is also determined if a flow of exhaust gas is not detected when the negative pressure is supplied to the EGR control valve.

According to this apparatus, however, although trouble in the EGR system can be detected, there is a problem in that it is impossible to determine whether the trouble is caused by the malfunction of the EGR control valve or by clogging of the EGR passage.

Also, according to the proposed apparatus, pressure-detection means is used for detecting whether or not the exhaust-gas is introduced into the EGR passage. However, since the pressure in the exhaust system varies in accordance with the rotational speeds or loads of the engine, it is not apparent that the pressure variation has occurred due to the lack of exhaust gas or due to the variation of the operative condition or of the environment. Accordingly, there has been a problem in the proposed apparatus in that a misdetermination of trouble in the EGR system may occur.

SUMMARY OF THE INVENTION

The object of the present invention is to provide a trouble-detection apparatus, for an EGR system comprising an EGR control valve in an EGR passage, which is capable of correctly detecting trouble in the EGR system by the detection of clogging of the EGR passage, irrespective of the pressure variation in the intake system in accordance with the rotational speeds or loads of the engine, the atmospheric pressure and the opening degree of a throttle valve.

Further, another object of the present invention is to provide a trouble-detection apparatus capable of determining that clogging in the EGR passage has occurred on the upstream side of the EGR control valve or on the downstream side thereof, in addition to the correct determination of the EGR control valve in the EGR system.

According to a first aspect of the present invention, a trouble-detection apparatus is proposed for an EGR system comprising an EGR passage for communicating an exhaust passage of an internal combustion engine with an intake passage thereof and an EGR control valve for controlling a flow rate of exhaust-gas recirculating through the EGR passage, wherein the apparatus comprises pulse-detection means provided in the EGR passage, for detecting pulses in the exhaust-gas flow, pulse amplitude-detection means for detecting an amplitude of the pulses in the exhaust-gas flow detected by the pulse-detection means, operation state-detection means for detecting the operation state in the internal combustion engine, and clogging-detection means for detecting clogging in the EGR passage in accordance with the detected amplitude of the pulses in the exhaust-gas flow and the detected operation state of the internal combustion engine.

preferably the trouble-detection apparatus of the first aspect wherein the pulse-detection means is provided in the EGR passage on the upstream side of the EGR control valve further comprises valve-opening detection means for detecting the open state of the EGR control valve, first abnormality detection means for detecting the clogging in the EGR passage on the upstream side of the EGR control valve in accordance with the detected amplitude of the pulses in the exhaust-gas flow and the operation state of the internal combustion engine when the EGR control valve is closed, and second abnormality detection means for detecting the clogging in the EGR passage on the downstream side of the EGR control valve in accordance with the detected amplitude of the pulses in the exhaust-gas flow and the operation state of the internal combustion engine when no clogging on the upstream side of the EGR control valve is detected by the first abnormality detection means.

According to a second aspect of the present invention, a trouble-detection apparatus is provided for an EGR system of an internal combustion engine comprising an EGR passage for communicating an exhaust passage of the internal combustion engine with an intake passage thereof and an EGR control valve for controlling a flow rate of exhaust-gas recirculating through the EGR passage, wherein the EGR control valve is controlled by a negative pressure so that the negative pressure supplied to the EGR control valve is controlled in a feedback manner in accordance with a lift amount of the EGR control valve detected by a lift sensor and the operation state of the engine; the apparatus comprising lift amplitude-detection means for detecting an amplitude of the detected value issued by the lift sensor, and clogging-detection means for detecting the clogging in the EGR passage in accordance with the calculated lift amplitude and the operation state of the internal engine.

The trouble-detection apparatus for the EGR system of the second aspect may further comprise the following elements: first EGR control valve abnormality determination means for determining that the EGR control valve has an overlift abnormality when the lift amount detected by the lift sensor exceeds a maximum target value, and second EGR control valve abnormality determination means for determining that the EGR control valve has an underlift abnormality when the lift amount detected by the lift sensor is lower than a minimum target value.

According to a third aspect of the present invention, a trouble-detection apparatus is provided for an EGR system of an internal combustion engine comprising an EGR passage for communicating an exhaust passage of the internal combustion engine with an intake passage thereof and an EGR control valve for controlling a flow rate of exhaust-gas recirculating through the EGR passage, wherein the EGR control valve is controlled by a negative pressure so that the negative pressure supplied to the EGR control valve is controlled in a feedback manner in accordance with a lift amount of the EGR control valve detected by a lift sensor and the operation state of the engine, the apparatus comprising lift amplitude-detection means for detecting an amplitude of the detected value issued from the lift sensor, pulse calculation means for calculating pulses in an exhaust-gas flow passing over the EGR control valve based on the detected amplitude of the pulses in the exhaust-gas flow, and clogging-detection means for detecting clogging in the EGR passage in accordance with the calculated amplitude of the pulses in the exhaust-gas flow and the operation state of the internal combustion engine.

The trouble-detection apparatus for the EGR system of the third aspect may further comprise the following elements: first EGR control valve abnormality determination means for determining that the EGR control valve has an overlift abnormality when the lift amount detected by the lift sensor exceeds a maximum target value, and second EGR control valve abnormality determination means for determining that the EGR control valve has an underlift abnormality when the lift amount detected by the lift sensor is lower than a minimum target value.

According to the trouble-detection apparatus for the EGR system of the first aspect, it is determined that clogging has occurred in the EGR passage when the detected amplitude of the pulses in the exhaust-gas flow is smaller than a threshold value corresponding to the operation state of the engine. According to the apparatus capable of detecting pulses in the exhaust-gas flow on the upstream side of the EGR control valve, it is determined that clogging has occurred on the upstream side of the EGR control valve if the clogging in the EGR passage is detected when the EGR control valve is in the close state, while it is determined that clogging has occurred on the downstream side of the EGR control valve if the clogging in the EGR passage is detected when the EGR control valve is in the open state.

According to the trouble-detection apparatus for the EGR system of the second aspect, wherein a negative pressure for the EGR control valve is controlled in a feedback manner by a lift amount of a valve body detected by the lift sensor, a lift amplitude is calculated from the values detected by the lift sensor, and it is determined that clogging has occurred in the EGR passage when the calculated lift amplitude is smaller than a preset amplitude corresponding to a normal operation state of the engine. Also, it is determined that the EGR control valve has an overlift amount abnormality when the lift amount detected by the lift sensor exceeds the maximum target value, while it is determined that the EGR control valve has an underlift abnormality when the detected lift amount is smaller than the minimum target value.

In addition, according to the trouble-detection apparatus for the EGR system of the third aspect, wherein a negative pressure for the EGR control valve is controlled in a feedback manner by a lift amount of a valve body detected by the lift sensor, pulses in the exhaust-gas flow passing over the EGR control valve are calculated from the amplitude of the lift amount of the lift body detected by the lift sensor, and it is determined that clogging has occurred in the EGR passage when the calculated amplitude of the pulses in the exhaust-gas flow is smaller than a preset amplitude corresponding to the normal operation state of the internal combustion engine. When the lift amount detected by the lift sensor exceeds the maximum target value, it is determined that the EGR control valve has an overlift abnormality, and when it is smaller than the minimum target value, it is determined that the EGR control valve has an underlift abnormality.

BRIEF DESCRIPTION OF THE DRAWINGS

The present invention will be more clearly understood from the description as set forth below with reference to the accompanying drawings.

FIG. 4 is a flowchart illustrating a series of steps in the embodiment shown in FIG. 1 for determining that clogging in the EGR passage of the EGR system has occurred on the upstream or on the downstream side of the EGR control valve;

DESCRIPTION OF THE PREFERRED EMBODIMENTS

Figure 1:
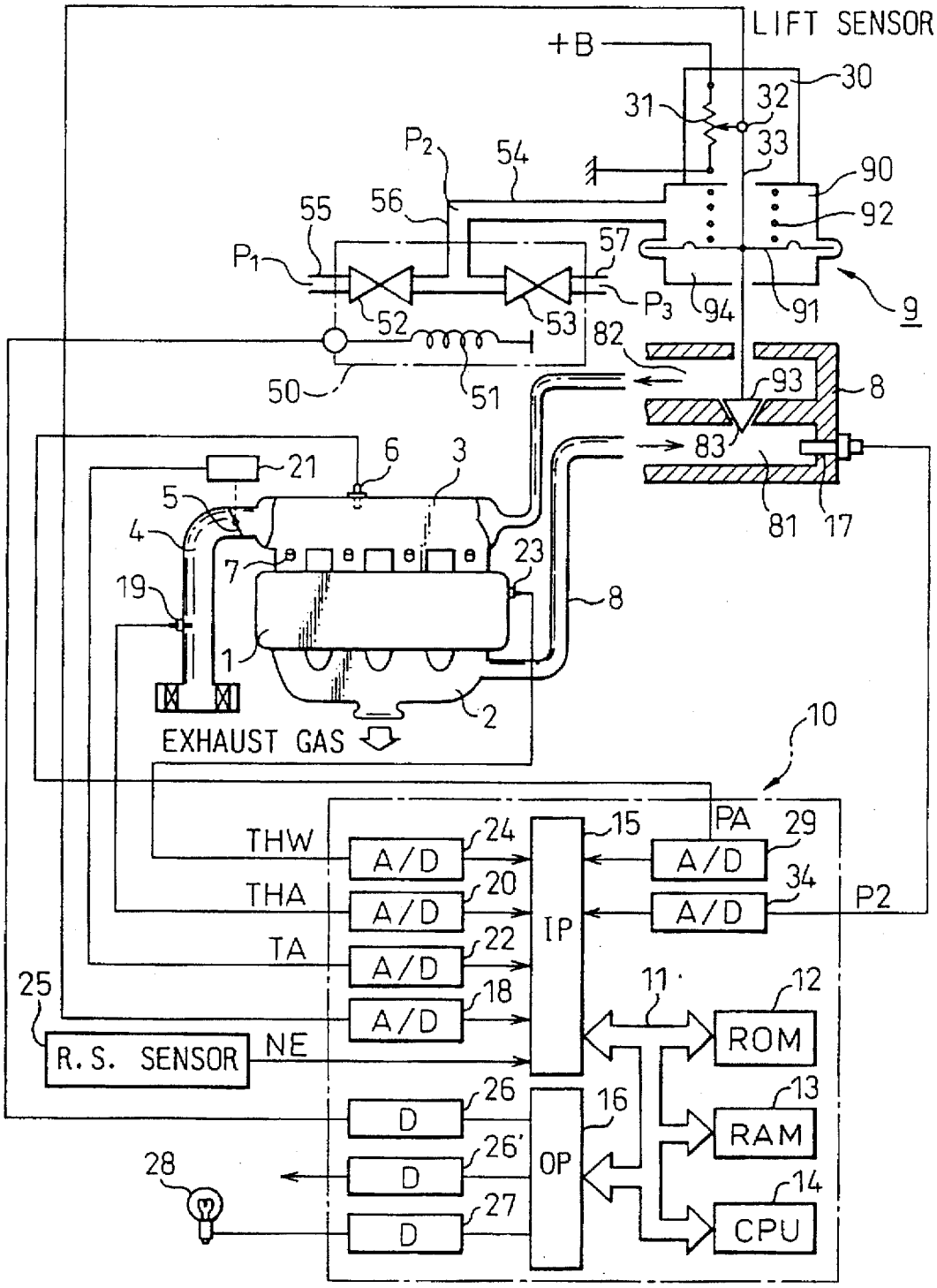
FIG. 1 illustrates a whole structure of a first embodiment of a trouble-detection apparatus for an EGR system according to the present invention.

FIG. 1 illustrates a structure of an internal combustion engine incorporating a trouble-detection apparatus for an EGR system according to a first embodiment of the present invention. In this drawing, reference numeral 1 denotes an engine body of an internal combustion engine of a four-cylinder type; 2 an exhaust manifold; 3 an intake manifold; 4 an intake duct; 5 a throttle valve provided in the intake duct; 6 a pressure sensor for the intake duct; 7 a fuel-injection valve attached to a branch of the intake manifold 3; 8 an EGR passage communicating the exhaust manifold 2 to the intake manifold 3; 9 an EGR control valve provided in the EGR passage 8; and 10 a control circuit (engine control unit: ECU). Exhaust gas in the exhaust manifold 2 is recirculated into the intake manifold 3 via the EGR passage 8 when the EGR control valve 9 is open.

The control circuit 10 is constituted, for example, by a microcomputer including ROM (read-only-memory) 12, RAM (random-access-memory) 13, CPU (central processing unit) 14, an input port 15 and an output port 16, each connected with the others by a tow-way bus. In the EGR control valve 9, a lift sensor 30 is provided for detecting the opening degree of a valve body. A value detected by the lift sensor 30 is input to the input port 15 via an A/D converter 18. An intake temperature sensor 19 is provided in the intake duct 4. A value THA detected by the intake temperature sensor 19 is input to the input port 15 via an A/D converter 20. A sensor 21 for detecting an opening degree of the throttle valve 5 is connected to the throttle valve 5. A value TA detected by the throttle opening degree sensor 21 is input to the input port 15 via an A/D converter 22.

The pressure sensor 6 is attached to a surge tank (intake manifold 3) provided downstream of the throttle valve 5. A value PA detected by the pressure sensor 6 is input to the input port 15 via an A/D converter 29. A water temperature sensor 23 is attached to the engine body 1, for detecting the temperature of the water for cooling the engine. A value THW detected by the water temperature sensor 23 is input to the input port 15 via an A/D converter 24. Further, a rotational speed sensor 25, connected to the input port 15, issues an output signal, representing a rotational speed NE of the engine. The output port 16 is connected, on one hand, to the fuel-injection valve 7 and a negative pressure control valve 50 corresponding thereto via driver circuits 26, 26' and, on the other hand, to an abnormality lamp 28 via a driving circuit 27.

In this embodiment, the negative pressure control valve 50 is a solenoid valve constituted by a solenoid 51, on-off valves 52, 53 to be opened and closed by the solenoid 51, and three connecting ports 55 through 57 wherein the connecting port 55 is open to the outer air, the connecting port 56 is connected to a negative pressure chamber 90 via a negative pressure conduit 54, and the connecting port 57 is coupled to a negative pressure generating part. The negative pressure control valve 50 is controlled so that the ON-OFF control of the on-off values 52, 53 is conducted in accordance with ON/OFF signals (duty signals) input to the solenoid 51 via the driver circuit 26. A negative pressure $P_2$ regulated at a predetermined pressure by a negative pressure $P_3$ input to the connecting port 57 and an atmospheric pressure $P_1$ input to the connecting port 55 is introduced to the negative pressure chamber 90 of the EGR control valve 9 from the connecting port 56 via the negative pressure conduit 54.

The interior of the EGR control valve 9 is partitioned by a diaphragm 91 into the negative pressure chamber 90 and an atmospheric pressure chamber 94. A shaft 33 is fixed to the diaphragm 91. In the interior of the negative pressure chamber 90, a spring 92 is provided for biasing the shaft 33 to the atmospheric pressure chamber 94. The aforesaid lift sensor 30 is attached this EGR control valve 9 and provided with a variable resistor 31 and a brush 32 fixed to the shaft 33 to slide together with the shaft 33. When the shaft 33 moves upward and downward by the control of the negative pressure control valve 50, the position of the variable resistor 31 relative to the brush 32 varies to change the voltage detected by the brush 32. An output detected by the brush 32 is sent to the input port 15 via the A/D converter 18.

A valve body 93 is attached to a free end of the shaft 33, for closing the EGR passage 8 when seated on a valve seat 83 provided midway in the EGR passage 8 and opening the same when released from the valve seat 83. The EGR passage 8 is divided into an upstream section 81 (on the exhaust pipe side) and a downstream section (on the intake pipe side) by the valve seat 83. Also, a pressure sensor 17 is provided in the exhaust pipe side section 81 of the EGR passage in this embodiment and an output of sensor 17 is connected to the input port 15 via an A/D converter 34.

According to the trouble-detection apparatus for the EGR system thus structured, the feedback control of the negative pressure control valve 50 is executed by the control circuit 10. That is, the negative pressure control valve 50 is driven in a feedback manner to attain a target lift value corresponding to the operation state of the internal combustion engine by detecting a lift amount of the shaft 33 through the lift sensor 30. Then, the negative pressure regulated to the pressure $P_2$ in accordance with the ON/OFF signal (duty signal) to the solenoid 51 is introduced to the EGR control valve 9, which lifts the valve body 93 from the valve seat 83 whereby the exhaust-gas from the exhaust manifold 2 is introduced to the intake manifold 3 to execute the EGR operation.

Figure 2:
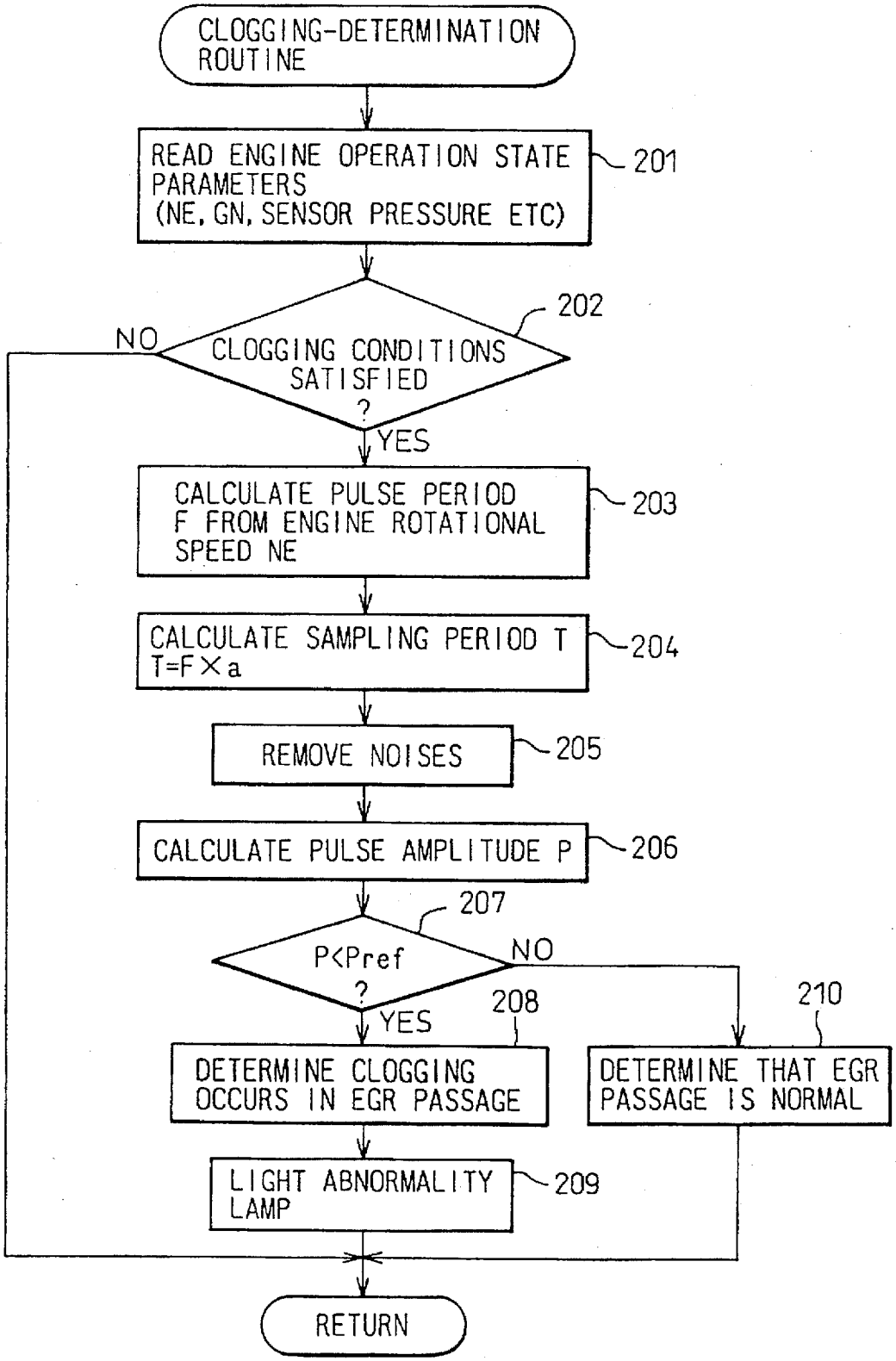
FIG. 2 is a flowchart illustrating a series of steps for determining clogging in the EGR passage of the EGR system of the embodiment shown in FIG. 1.

Next, the steps for determining clogging in the EGR passage 8 of the first embodiment will be explained with reference to a flowchart shown in FIG. 2.

At step 201, operation state parameters of the engine (such as an engine load GN calculated by an air amount per one rotation of the engine, an engine rotational speed NE, an opening degree of throttle TA, a sensor pressure $P_2$, an intake pressure PA or a water temperature THW) are read. At step 202, it is determined from the operation state parameters that whether or not conditions are satisfied for representing clogging in the EGR passage 8. The determination conditions are as follows, wherein GN1, GN2, NE1, NE2, TA1 and TA2 represent constants:

(1) the load is in a predetermined range (GN1<GN<GN2), (2) the rotational speed is in a predetermined range (NE1<NE<NE2), (3) the opening degree of throttle is in a predetermined range (TA1<TA<TA2), (4) the engine is not in a transfer state (a change ΔTA of the opening degree of the throttle is less than a predetermined value), (5) the lift sensor is normal (not broken), and (6) all of the above conditions are continuously satisfied for at least a predetermined period.

If the conditions defined by items (1) through (6) are all satisfied, the engine is in a stable operation state wherein the EGR flow rate is proper and the amplitude of pulses in the exhaust-gas flow is stable. In this embodiment, since such pulses in the exhaust-gas flow are detected by the pressure sensor 17 which senses the same by the pressure propagation, the response delay is very small and the pulses can be detected even when the EGR flow rate is small.

If the above conditions defined by item (1) through (6) are not satisfied at step 202, the routine is finished, while if they are satisfied, the control proceeds to step 203.

At step 203, the period F of the pulses in the exhaust-gas flow of the four-cylinder type internal combustion engine is calculated based on the engine rotational speed NE. And, at step 204, a sampling period T is calculated in accordance with the period of pulses in the exhaust-gas flow by the following equation:

$$T=F\times a$$

The reason why the sampling period T is calculated in such a manner is that, since the pulses in the exhaust-gas flow vary with the engine rotational speed NE when the same are detected by the pressure sensor 17, it is necessary to synchronize the timing of A/D conversion with the frequency of the pulses for the purpose of obtaining a correct A/D conversion. Accordingly, the period F of the pulses in the exhaust-gas flow is obtained by the engine rotational speed NE at step 203, and the sampling period T is obtained by multiplying a coefficient a thereto at step 204. In this embodiment, the A/D conversion is executed at the sampling period T.

At the next step 205, noise is removed from the values detected by the pressure sensor 17. The noise removal can be executed by cutting a frequency component which could not possibly be generated in a normal engine operation state; for example, frequencies in a range between $F-\alpha<F+\alpha$ are extracted from the detected value, wherein $\alpha$ is a predetermined frequency and F is the frequency of the values detected by the pressure sensor 17. More specifically, the values detected by the pressure sensor 17 are made to pass through a bandpass filter having a frequency band in a range between $F-\alpha<F+\alpha$.

Next, at step 206, the amplitude P of the pulses in the exhaust-gas flow is calculated by the values detected by the pressure sensor 17. The pulse amplitude P is obtainable by a difference between a maximum value $P_{max}$ and a minimum value $P_{min}$ which are detected by the pressure sensor 17 during a period longer than one cycle of the pulses in the exhaust-gas flow.

At step 207, it is determined that whether or not the pulse amplitude P calculated from the values detected by the pressure sensor 17 is smaller than a preset amplitude $P_{ref}$ in a normal operation state of the engine. If P is larger than or equal $P_{ref}$, the control proceeds to step 210 at which the routine is finished after the determination that the EGR passage 8 is normal. On the other hand, if P is smaller than $P_{ref}$ at step 207 the control proceeds to step 208. At step 208, it is determined that clogging has occurred in the EGR passage 8, and the control proceeds to step 209. At step 209, the abnormality lamp 29 is lit to warn the driver that clogging has occurred in the EGR passage 8, and the routine is finished.

FIG. 3 illustrates wave shapes in the respective positions in FIG. 1 in both the normal and the abnormal states when the determination of clogging in the EGR passage 8 is conducted in accordance with the steps explained with reference to FIG. 2. First, FIG. 3A illustrates a wave shape of a drive signal for a negative pressure control valve (VSV); i.e., the EGR control valve 9; which is input to the solenoid 51 of the negative pressure control valve 50 from the controller 10. FIG. 3B illustrates a wave shape a lift signal representing a lift amount of the valve body 93 in the EGR control valve issued from the lift sensor 30 when the EGR control valve 9 is driven by supplying the drive signal shown in FIG. 3A to the solenoid 51 in the negative pressure control valve 50 when the engine is inoperative. When the pulse signal of 50% duty shown in FIG. 3A is supplied to the solenoid 51 in the inoperative state of the engine, the EGR control valve 9 repeats the periodic up-down motion.

Figure 3A:
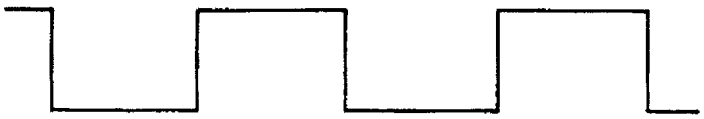
FIG. 3A illustrates a wave shape of a drive signal for the EGR control valve in FIG. 1.
Figure 3B:
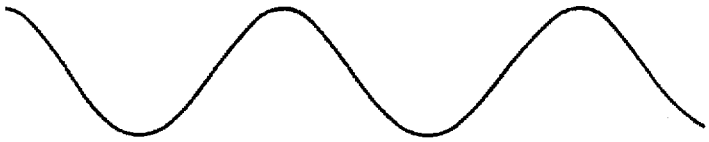
FIG. 3B illustrates a wave shape of a lift signal of the EGR control valve issued from the lift sensor when the EGR control valve is driven by the drive signal shown in FIG. 3A while the engine is inoperative.
Figure 3C:
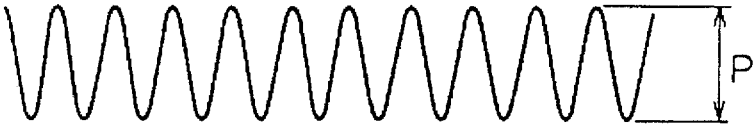
FIG. 3C illustrates a wave shape of pulses in the exhaust-gas flow in a normal state wherein no clogging has occurred in the EGR passage.
Figure 3D:
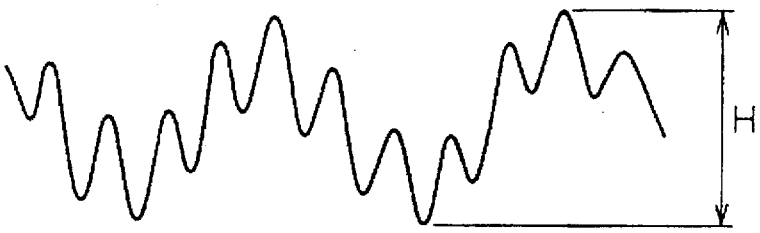
FIG. 3D illustrates a wave shape of the lift signal of the EGR control valve due to the pulses of the exhaust-gas flow detected by the lift sensor, when the EGR control valve is driven by the drive signal shown in FIG. 3A.
Figure 3E:
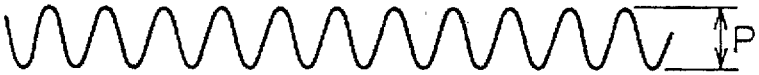
FIG. 3E illustrates a wave shape of the pulses of the exhaust-gas flow when clogging has occurred in the EGR passage.

The exhaust-gas flowing in the EGR passage 8 pulses as shown in FIG. 3C when the engine is operated and no clogging has occurred in the EGR passage 8. Therefore, the amplitude P of the pulses in the exhaust-gas flow obtained from the values detected by the pressure sensor 17 becomes larger. Contrarily, the pulses in the exhaust-gas flow flowing in the EGR passage are smaller as shown in FIG. 3E when the engine is operated and the clogging has occurred in the EGR passage 8. Accordingly, the amplitude P of the pulses in the exhaust-gas flow obtained from the values detected by the pressure sensor 17 becomes smaller. The present amplitude $P_{ref}$ used at step 207 is determined to be a value capable of discriminating the wave shapes shown in FIGS. 3C and 3E, respectively, from each other.

As described above, according to the trouble-detection apparatus of the EGR system of the first embodiment, since the clogging in the EGR passage 8 is determined by directly detecting the amplitude of the pulses in the exhaust-gas flow by the pressure sensor, it is possible to correctly determine the abnormality irrespective of the variations of the rotational speed or load of the engine, the atmospheric pressure, the opening degree of the throttle or others.

In this regard, in the trouble-detection apparatus for the EGR system explained with reference to FIG. 1, it is also possible to determine that the clogging has occurred in the EGR passage 8 on the upstream side (exhaust manifold side 2) or on the downstream side (intake manifold side 3).

One example of the steps will be described with reference to the flowcharts, shown in FIG. 4, for determining that the clogging in the EGR passage 8 has occurred on the upstream side of the EGR control valve 9 or on the downstream side thereof, wherein the same step numbers are used for denoting the same steps as those of FIG. 2 and the explanation thereof is omitted.

At step 201, the operation state parameters of the engine are read. At step 401, it is determined whether or not the engine is in an idling state. If the engine is in the idling state, no EGR is executed and therefore the EGR control valve 9 is open. According to this embodiment, when the combustion engine is in the idling state, the clogging in the EGR passage 8 on the upstream side of the EGR control valve 9 can be detected, which will be first explained.

At step 403, the period F of the pulses in the exhaust-gas flow in the four-cylinder type internal combustion engine is calculated, and at the next step 404, the sampling period T (=F×a) is calculated in accordance with the period of the pulses in the exhaust-gas flow. At step 405, the noise removal from the value detected by the pressure sensor 17 is executed by a filter or the like, and at step 406, the amplitude P of the pulses in the exhaust-gas flow is calculated from the value detected by the pressure sensor 17.

At the next step 407, it is determined whether or not the amplitude P of the pulses in the exhaust-gas flow is smaller than the preset amplitude $P_{ref}$ in the normal operation state of the engine obtained at step 406, and if P is larger than $P_{ref}$ or equal thereto, the control proceeds to step 411 at which it is determined whether or not the EGR passage 8 is normal. If the answer is "1" at step 412, a flag E representing the clogging in the upstream side (exhaust manifold side) in the EGR passage 8 becomes "0" and the routine is finished. On the other hand, if the P is smaller than $P_{ref}$ at step 407, the control proceeds to step 408, at which it is determined that the clogging has occurred on the upstream side in the EGR passage 8. Then, the flag E representing the clogging in the upstream side in the EGR passage 8 becomes "1" at step 409, and the routine is finished at step 410 after the abnormality lamp 28 is lit.

If the engine is not in the idling state at step 401, the control proceeds to step 202. At step 202, it is determined whether or not determination conditions for the clogging of the EGR passage 8 are satisfied in accordance with the operation state parameters. The determination conditions are identical to the above-mentioned items (1) through (6). If these determination conditions (1) through (6) are not satisfied at step 202, the routine is finished; while the conditions are satisfied, the control proceeds to step 203.

At step 203, the period F of the pulses in the exhaust-gas flow is calculated from the rotational speed NE of the engine, and at step 204, the sampling period T in accordance with the period of the pulses in the exhaust-gas flow is calculated by the equation T=F×a. At step 205, the noise removal is executed, and at step 206, the amplitude P of the pulses in the exhausted-gas flow is calculated from the values detected by the pressure sensor 17.

Thereafter, at step 207, it is determined whether or not the amplitude P of the pulses in the exhausted-gas flow is smaller than the preset amplitude $P_{ref}$ in the normal operation state of the engine, wherein if P is larger than $P_{ref}$, the control proceeds to step 413. At step 413, it is determined whether or not the flag E representing the clogging on the upstream side in the EGR passage 8 is "1"; i.e., the clogging has already occurred on the upstream side in the EGR passage 8; and if the answer is affirmative wherein the clogging has already occurred on the upstream side in the EGR passage 8, the routine is finished. On the contrary, if the answer is negative wherein no clogging has occurred on the upstream side in the EGR passage 8, the control proceeds to step 208' at which it is determined that the clogging has occurred on the downstream side in the EGR passage 8. In this case, the routine is finished after a flag I representing the clogging occurring on the downstream side (intake manifold side) in the EGR passage 8 becomes "1" and the abnormality lamp 28 is lit at step 209.

If P is larger than or equal to $P_{ref}$ at step 207, the control proceeds to step 210 at which it is determined that the EGR passage 8 is normal, and the routine is finished at step 402 after the flag E becomes "0" representing the clogging on the upstream side in the EGR passage 8 and the flag I representing the clogging on the downstream side in the EGR passage 8 becomes "0".

As described above, in the embodiment stated with reference to FIGS. 4A and 4B, since the clogging on the exhaust side in the EGR passage 8 can be detected by the detection of the amplitude of the pulses in the exhaust-gas flow by the pressure sensor even when the normal operation state of the engine wherein the EGR control valve 9 is open, it is possible to determine that the clogging in the EGR passage 8 has occurred whether on the upstream side or the downstream side of the EGR control valve.

Figure 5:
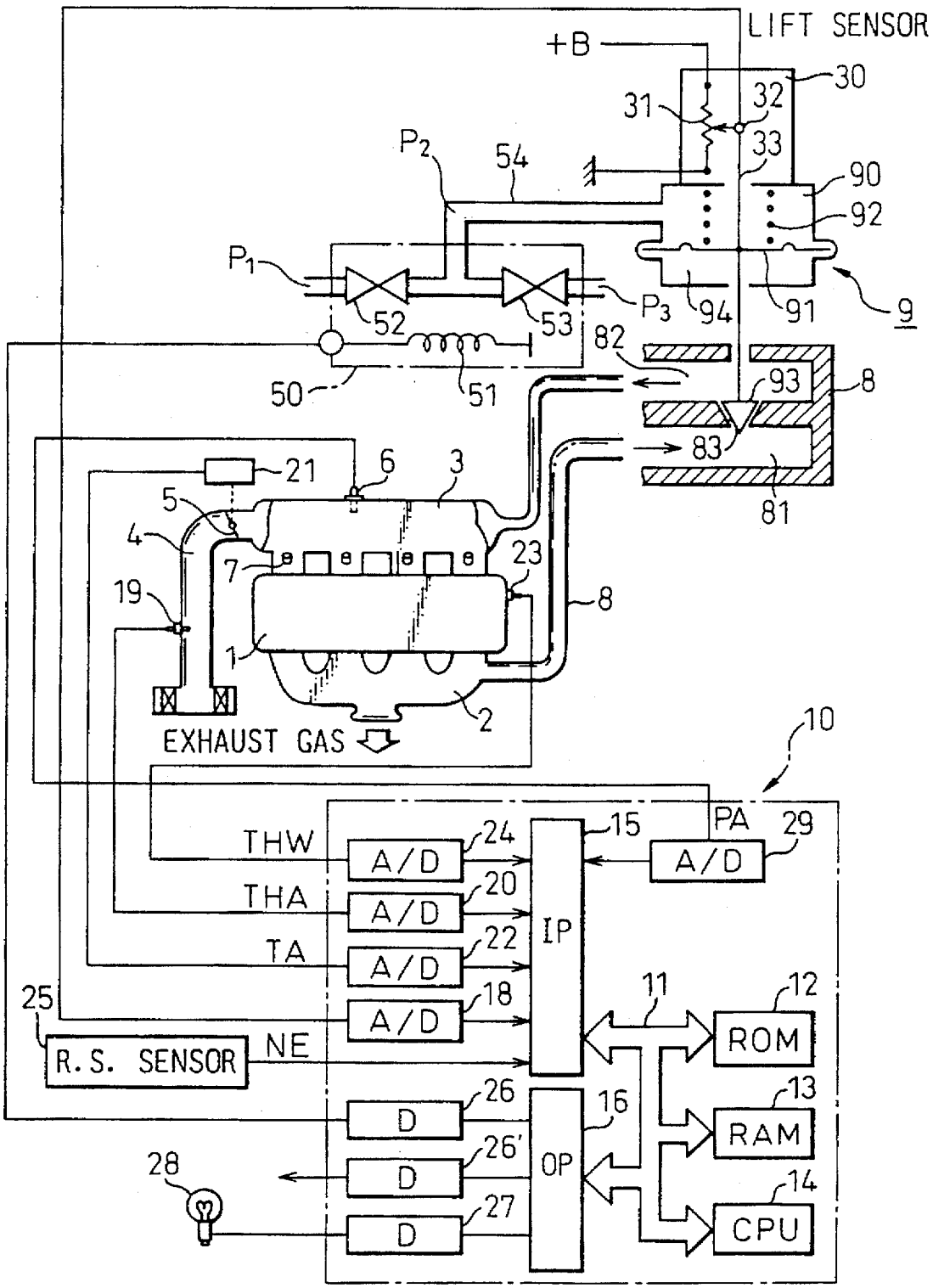
FIG. 5 illustrates a whole structure of a second embodiment of a trouble-detection apparatus for an EGR system according to the present invention.

FIG. 5 illustrates a whole structure of an internal combustion engine provided with a second embodiment of the trouble-detection apparatus for the EGR system according to the present invention. The structure of the trouble-detection apparatus in the second embodiment is substantially the same as the trouble-detection apparatus for the EGR system in the first embodiment stated with reference to FIG. 1, except that the pressure sensor 17 is not provided on the upstream side of the EGR control valve 9 in the EGR passage 8, and therefore, the explanation of the same elements will be omitted while denoting the same with the same reference numerals.

Figure 6:
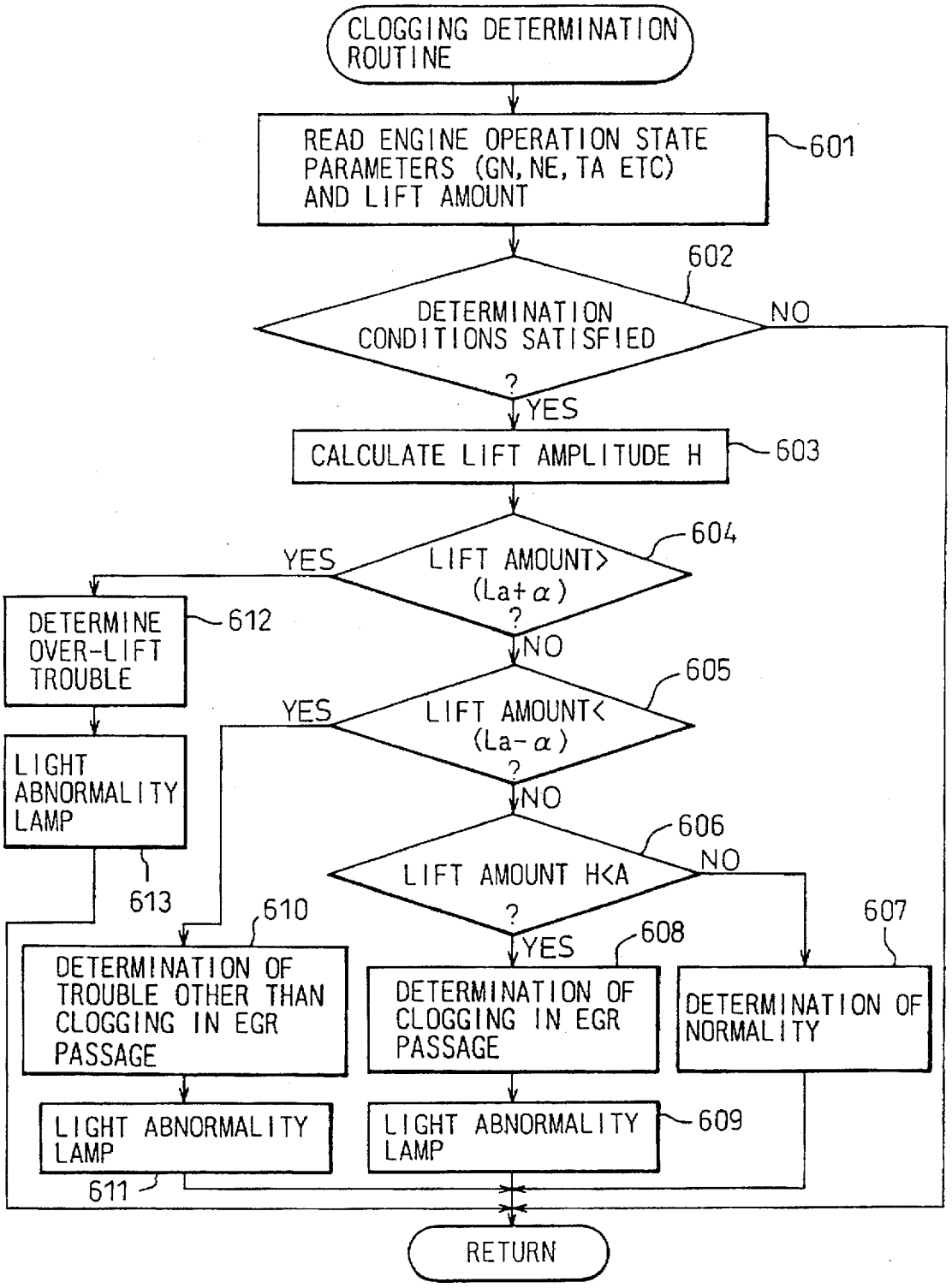
FIG. 6 is a flowchart illustrating a series of steps for determining clogging in the EGR passage of the EGR system of the embodiment shown in FIG. 5.

FIG. 6 is a flowchart illustrating an example of the steps for determining the trouble of the EGR control valve 9 in the EGR system and the clogging in the EGR passage in the embodiment shown in FIG. 5.

At step 601, the operation state parameters of the engine, such as a load GN or a rotational speed NE of the engine, an opening degree TA of a throttle, a sensor pressure $P_2$, an intake pressure PA, a water temperature THW or a lift amount of a valve body in the EGR control valve, are read. At step 602, it is determined whether or not determination conditions for the clogging in the EGR passage 8 are satisfied as defined by the following items (1) through (6):

(1) the load is in a predetermined range (GN1<GN<GN2), (2) the rotational speed is in a predetermined range (NE1<NE<NE2), (3) the opening degree of throttle is in a predetermined range (TA1<TA<TA2), (4) the engine is not in a transfer state (an acceleration ΔTA of the opening degree of throttle is less than a predetermined value), (5) the lift sensor is normal (not broken), and (6) all of the above conditions are continuously satisfied for at least a predetermined period.

If the determination conditions as defined by the above items (1) through (6) are not satisfied at step 602, the routine is finished, while if they are satisfied, the control proceeds to step 603.

At step 603, an amplitude H of the lift amount of the valve body 93 of the EGR control valve 9 detected by the lift sensor 30 is calculated. The lift amplitude H can be obtained after a maximum value $H_{max}$ and a minimum value $H_{min}$ have been determined from data obtained through the lift sensor 30 during a certain period longer than the pulse period of the exhaust-gas flow, as a difference between $H_{max}$ and $H_{min}$. At the next step 604, it is determined whether or not a value of the lift amount of the valve body 93 of the EGR control valve 9 detected by the lift sensor 30 is larger than a target lift amount La plus a predetermined value α. If the lift amount is larger than La plus α, the control proceeds to step 612, at which it is determined that an overlift trouble has occurred in the EGR control valve 9, and the routine is finished after the abnormality lamp 28 is lit at step 613. On the other hand, if the lift amount is smaller than or equal to La plus α at step 604, the control proceeds to step 605.

At step 605, it is determined that whether or not the lift amount of the valve body 93 of the EGR control valve 9 detected by the lift sensor 30 is smaller than a target lift amount La minus predetermined value β. If the lift amount is smaller than La minus β, the control proceeds to step 610, at which it is determined that a trouble has occurred in the EGR system, other than the clogging in the EGR passage 8, and the routine is finished after the abnormality lamp 28 is lit at step 611. On the other hand, if the lift amount is larger than or equal to La minus β at step 604, the control proceeds to step 606.

At step 606, it is determined whether or not the lift amplitude calculated at step 603 is smaller than a predetermined value A. If the lift amplitude H is larger than or equal to the predetermined value A, the control proceeds to step 607, at which it is determined that the EGR passage 8 is normal with no clogging therein, and the routine is finished. On the contrary, if the lift amount H is smaller than A at step 606, the control proceeds to step 608, at which it is determined that clogging has occurred in the EGR passage 8, and the routine is finished after the abnormality lamp 28 is lit at the next step 609.

As described above, according to the second embodiment, the trouble-detection is executed while using a variation of the lift amount of the valve body 93 of the EGR control valve 9 due to the pulses in the exhaust-gas flowing through the EGR passage 8, wherein the pulses in the exhaust-gas flow are detected in accordance with a magnitude of amplitude H of the lift amount of the valve body 93 of the EGR control valve 9 detected by the lift sensor 30. This process will be described in more detail with reference to FIGS. 3A through 3F.

FIGS. 3A through 3F illustrate wave shapes in the respective positions in FIG. 5 in both of normal and abnormal states. First, FIG. 3A illustrates a wave shape of a drive signal for the EGR control valve 9, which is input to the solenoid 51 of the negative pressure control valve 50 from the controller 10. FIG. 3B illustrates a wave shape a lift signal representing a lift amount of the valve body 93 in the EGR control valve issued from the lift sensor 30 when the EGR control valve 9 is driven by supplying the drive signal shown in FIG. 3A to the solenoid 51 in the negative pressure control valve 50 when the engine is inoperative. When the pulse signal of 50% duty shown in FIG. 3A is supplied to the solenoid 51 in the inopeartive state of the engine, the EGR control valve 9 repeats the periodic up-down motion.

The exhaust-gas flowing through the EGR passage 8 pulses as shown in FIG. 3C when the engine is operated and no clogging occurs in the EGR passage 8. In the EGR control valve 9 wherein a diaphragm 91 is displaced due to a negative pressure in the negative pressure chamber 90 to conduct the positioning of the valve body 93, the lift amount of the valve body 93 of the EGR control valve 9 varies in accordance with the pulses in the exhaust-gas flow and the wave shape of the lift signal actually detected by the lift sensor 30 is shown in FIG. 3D. That is, when no clogging has occurred in the EGR passage 8, the wave shape of the pulses in the exhaust-gas flow shown in FIG. 3C is overlapped with the wave shape of the lift signal shown in FIG. 3B. The lift amplitude H obtained at step 603 in FIG. 6 is the maximum amplitude of the wave shape shown in FIG. 3D.

Figure 3F:
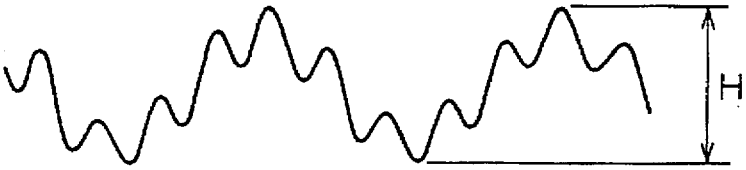
FIG. 3F illustrates a wave shape of the lift signal of the EGR control valve due to the pulses in the exhausted-gas flow, detected by the lift sensor, when the EGR control valve is driven by the drive signal shown in FIG. 3A.

On the other hand, if the engine is in operation and clogging has occurred in the EGR passage 8, the pulses in the exhaust-gas flow flowing through the EGR passage, 8 becomes smaller as shown in FIG. 3E. In such a case, the wave shape of the pulses in the exhaust-gas flow having a smaller amplitude as shown in FIG. 3E is overlapped with the wave shape of the signal shown in FIG. 3B. Accordingly, the amplitude H of the wave shape of the lift signal detected by the lift sensor 30 becomes smaller as shown in FIG. 3F compared with a case wherein no clogging has occurred in the EGR passage 8. The predetermined amplitude A used at step 606 is determined to be a value capable of discriminating the wave shapes shown in FIGS. 3D and 3F, respectively, from each other.

As stated above, according to the second embodiment of the trouble-detection apparatus for the EGR system, since the clogging of the EGR passage 8 is determined by detecting the amplitude of the pulses in the exhaust-gas flow while using the variation of the lift sensor 30 provided in the trouble-detection apparatus for the EGR system, the pressure sensor 17 used in the first embodiment is unnecessary, and it is possible to correctly determine the abnormality, irrespective of the variation of the rotational speed or load of the engine, the atmospheric pressure or the opening degree of the throttle.

Figure 7:
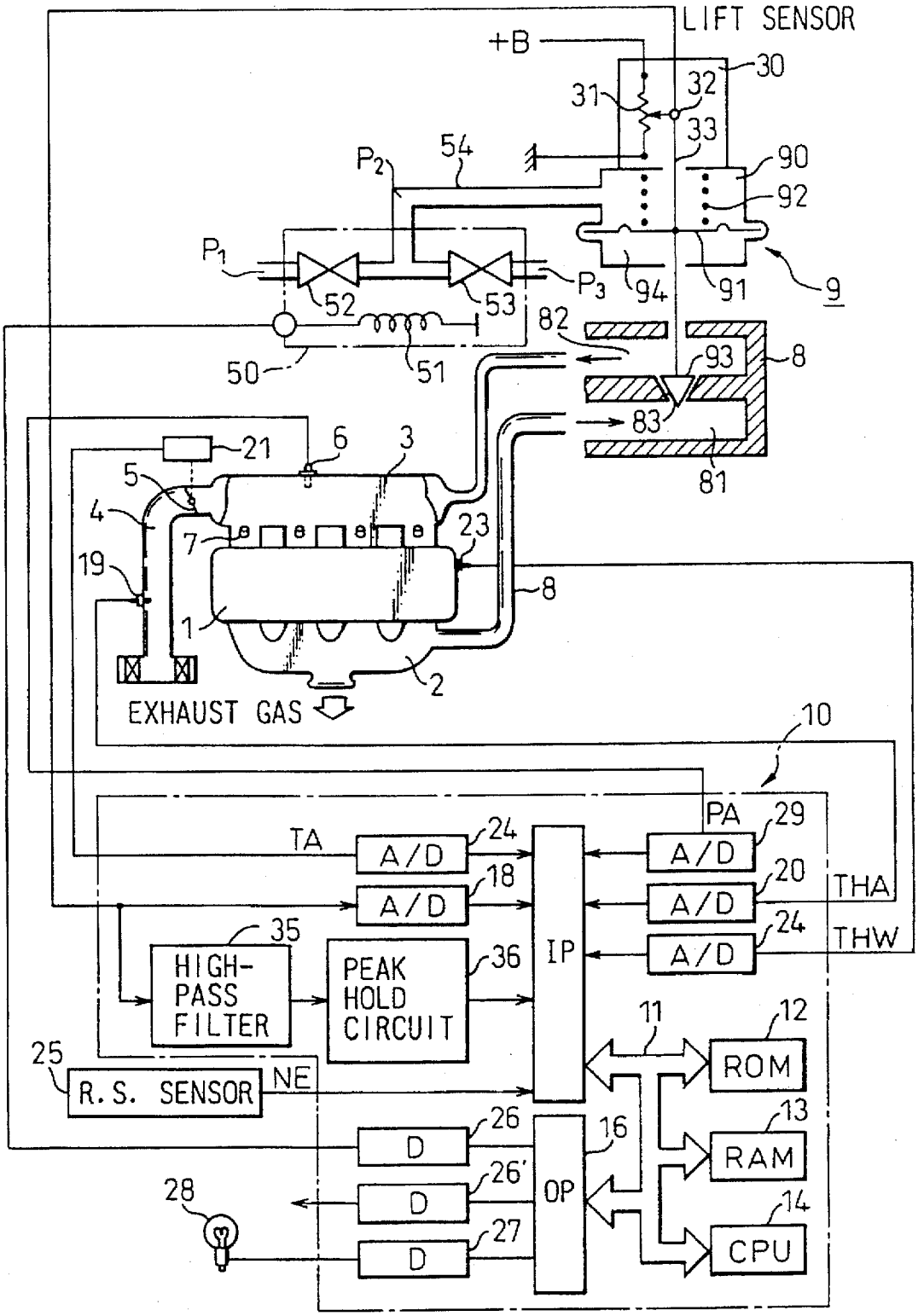
FIG. 7 illustrates a whole structure of a third embodiment of a trouble-detection apparatus for an EGR system according to the present invention.

FIG. 7 illustrates a whole structure of the internal combustion engine provided with a third embodiment of the trouble-detection apparatus for the EGR system according to the present invention. The difference in the trouble-detection apparatus for the EGR system according to the third embodiment from that shown in FIG. 5 resides solely in that an output from the lift sensor 30 is divided into two in the control circuit 10; one being input to the input port 15 via the A/D converter 24, and the other being input to the input port 15 via a high-pass filter 35 and a peak hold circuit 36. Therefore, the same parts as in FIG. 5 are denoted by the same reference numerals and the explanation thereof will be omitted.

According to the trouble-detection apparatus for the EGR system shown in FIG. 5, the lift amount detected by the lift sensor 30 is input to the input port after being converted from analog to digital. On the other hand, according to the trouble-detection apparatus for the EGR system shown in FIG. 7, the lift amount detected from the lift sensor 30 is not only input to the input port after being converted from analog to digital but also processed through the high-pass filter 35 so that a higher frequency component is solely extracted from the detected lift amount. This higher frequency component is the pulse component in the exhaust gas flow of the engine which has been incorporated into the value detected by the lift sensor 30 shown in FIGS. 3D and 3F. Accordingly, the signal output from the high-pass filter 35 is of a shape similar to that of the pulses in the exhaust-gas flow in the EGR passage 8 shown in FIGS. 3C and 3E. Also, since maximum and minimum values are detected from the signals output from the high-pass filter 35 by the peak hold circuit 36, it is possible in the control circuit 10 to detect an amplitude PH of the pulses in the exhaust-gas flow from signals issued from the lift sensor 30.

Figure 8:
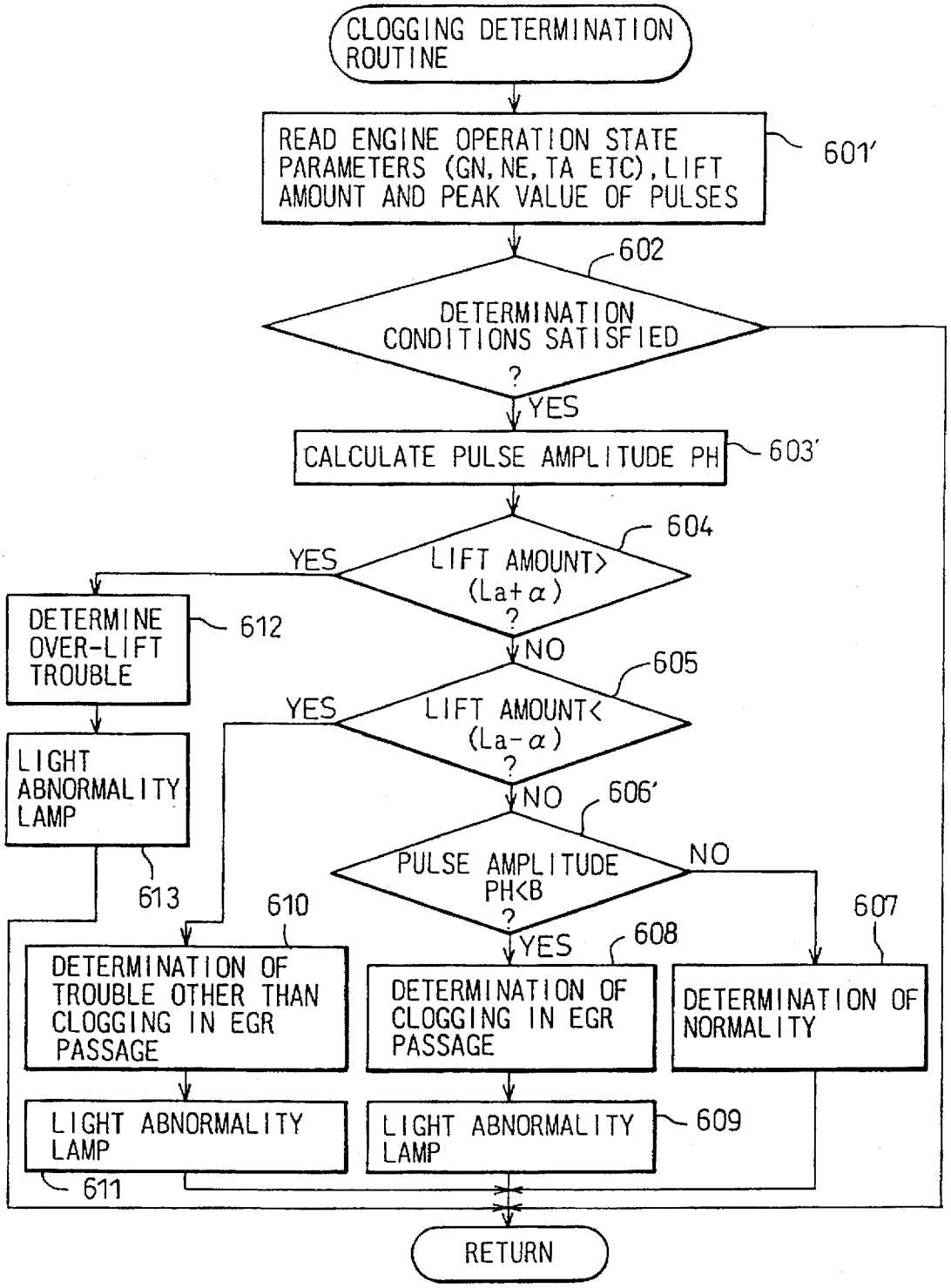
FIG. 8 is a flowchart illustrating a series of steps for determining clogging in the EGR passage of the EGR system of the embodiment shown in FIG. 7.

FIG. 8 is a flowchart illustrating the steps for determining clogging of the EGR passage in the EGR system in the embodiment shown in FIG. 7. As these steps are substantially the same as those already explained with reference to FIG. 6, the same steps are denoted by the same numbers and the explanation thereof will be omitted for the purpose of simplicity.

At step 601', in addition to the operation state parameters of the engine read at step 601 in FIG. 6, a peak value of the exhaust-gas flow obtained from the peak hold circuit 36 shown in FIG. 7 is read. At step 602, it is determined from the operation state parameters whether or not the conditions (1) through (6) for determining the clogging in the EGR passage 8 are satisfied. If the conditions are not satisfied, the routine is finished. While, if the conditions are satisfied, the control proceeds to step 603'.

At step 603', the amplitude PH of the pulses in the exhaust-gas flow is calculated from the peak value read at step 601'. The amplitude PH can be obtained as a difference between a maximum value $PH_{max}$ and a minimum value $PH_{min}$ in data obtained from the peak hold circuit 36 during a period longer than the period of the pulses in the exhaust-gas flow. At the next step 604, it is determined that whether or not the lift amount of the valve body 93 of the EGR control valve 9 detected by the lift sensor 30 is larger than the target lift amount La plus $\alpha$. If the lift amount is larger than La plus $\alpha$, the control proceeds to step 612, at which it is determined that the EGR control valve 9 has an overlift trouble, and the routine is finished after the abnormality lamp 28 is lit at step 613. On the other hand, the lift amount is smaller than or equal to La plus $\alpha$ at step 604, the control proceeds to step 605.

At step 605, it is determined whether or not the lift amount detected by the lift sensor 30 is smaller than the target lift amount La minus $\beta$. If the lift amount is smaller than La minus $\beta$, the control proceeds to step 610, at which it is determined that the EGR system has a trouble other than clogging in the EGR passage 8. Then the abnormality lamp 28 is lit at step 611 and the routing is finished. On the other hand, if the lift amount is larger than or equal to La minus β, the control proceeds to step 606'.

At step 606', it is determined whether or not the amplitude PH of the pulses in the exhaust-gas flow calculated at step 603 is smaller than a predetermined value B. If the amplitude PH of the pulses in the exhaust-gas flow is larger than or equal to the predetermined value B, the control proceeds to step 607, at which it is determined that the EGR passage 8 is in a normal state with no clogging therein, and the routine is finished. On the other hand, if the amplitude PH of the pulses in the exhaust-gas flow is smaller than B at step 606', the control proceeds to step 608, at which it is determined that the clogging has occurred in the EGR passage 8. At the next step 609, the abnormality lamp 28 is lit and the routine is finished. The predetermined value B used at step 606' is determined to be a value capable of discriminating the amplitudes PH of the pulses in the exhaust-gas flow when the EGR passage 8 is in a normal state and in a clogging state, from each other.

As stated above, according to the third embodiment, a vibration component of the lift amount of the valve body 93 of the EGR control valve 9 due to the pulses in the exhaust-gas flow is solely extracted, and the magnitude of the amplitude PH of the vibration component is used for detecting the clogging in the EGR passage 8. According to the third embodiment, since the vibration component due to the pulses in the exhaust-gas flow is solely extracted from data detected by the lift sensor 30 in such a manner, it is possible to eliminate the pressure sensor 17 for detecting a pressure of the exhaust-gas and to correctly determine the abnormality irrespective of the variation of the rotational speed or a load of the engine, the atmospheric pressure or the opening degree of the throttle.

As described above, according to the present invention, it is possible to correctly determine trouble in the EGR passage in the EGR system provided with the EGR control valve in the EGR passage, irrespective of the pressure variation in accordance with the rotational speed, load of the engine, the atmospheric pressure and the opening degree of the throttle, by detection of the clogging in the EGR passage. In addition to the correct determination of the trouble in the EGR control valve in the EGR system, it is also possible to determine that the clogging in the EGR passage has occurred on the upstream side or on the downstream side of the EGR control valve.

What is claimed is:

1. A trouble-detection apparatus for an EGR system comprising an EGR passage for communicating an exhaust passage of an internal combustion engine with an intake passage thereof and an EGR control valve for controlling a flow rate of exhaust-gas recirculating through the EGR passage, wherein the apparatus comprises:

pulse-detection means provided in the EGR passage, for detecting pulses in the exhaust-gas flow;

pulse amplitude-detection means for detecting an amplitude of the pulses in the exhaust-gas flow detected by the pulse-detection means;

operation state-detection means for detecting the operation state in the internal combustion engine; and clogging-detection means for detecting clogging in the EGR passage in accordance with the detected amplitude of the pulses in the exhaust-gas flow and the detected operation state of the internal combustion engine.

2. A trouble-detection apparatus for an EGR system as defined by claim 1, wherein the pulse-detection means comprises a pressure sensor.

3. A trouble-detection apparatus for an EGR system as defined by claim 2, wherein the clogging-detection means determines that the clogging has occurred in the EGR passage if the amplitude of the pulses in the exhaust-gas flow is smaller than a preset amplitude corresponding to a normal operation state of the engine.

4. A trouble-detection apparatus for an EGR system as defined by claim 1, wherein the pulse-detection means is provided in the EGR passage on the upstream side of the EGR control valve, further comprising:

valve-opening detection means for detecting the open state of the EGR control valve;

first abnormality detection means for detecting the clogging in the EGR passage on the upstream side of the EGR control valve in accordance with the detected amplitude of the pulses in the exhaust-gas flow and the operation state of the internal combustion-engine when the EGR control valve is closed; and second abnormality detection means for detecting the clogging in the EGR passage on the downstream side of the EGR control valve in accordance with the detected amplitude of the pulses in the exhaust-gas flow and the operation state of the internal combustion engine when no clogging on the upstream side of the EGR control valve is detected by the first abnormality detection means.

5. A trouble-detection apparatus for an EGR system as defined by claim 4, wherein the pulse-detection means comprises a pressure sensor, and the valve-opening detection-means comprises a lift sensor for detecting a lift amount of the EGR control valve.

6. A trouble-detection apparatus for an EGR system as defined by claim 5, wherein the first abnormality detection means determines that the clogging has occurred in the EGR passage when the amplitude of the pulses in the exhaust-gas flow is smaller than a present amplitude corresponding to an idling state of the engine, and the second abnormality detection means determines that the clogging has occurred in the EGR passage when the amplitude of the pulses in the exhaust-gas flow is smaller than a preset amplitude corresponding to a normal operating state of the engine.

7. A trouble-detection apparatus for an EGR system of an internal combustion engine comprising an EGR passage for communicating an exhaust passage of the internal combustion engine with an intake passage thereof and an EGR control valve for controlling a flow rate of exhaust-gas recirculating through the EGR passage, wherein the EGR control valve is controlled by a negative pressure so that the negative pressure supplied to the EGR control valve is controlled in a feedback manner in accordance with a lift amount of the EGR control valve detected by a lift sensor and the operation state of the engine, the apparatus comprises:

lift amplitude-detection means for detecting an amplitude of the detected value issued from the lift-sensor; and clogging-detection means for detecting the clogging in the EGR passage in accordance with the calculated lift amplitude and the operation state of the internal engine.

8. A trouble-detection apparatus for an EGR system as defined by claim 7, further comprising:

first EGR control valve abnormality determination means for determining that the EGR control valve has an overlift abnormality when the lift amount detected by the lift sensor exceeds a maximum target value; and second EGR control valve abnormality determination means for determining that the EGR control valve has an underlift abnormality when the lift amount detected by the lift sensor is lower than a minimum target value.

9. A trouble-detection apparatus for an EGR system as defined by claim 7, wherein the clogging-detection means determines that the clogging has occurred in the EGR passage when the lift amplitude is smaller than a preset amplitude corresponding to the normal operating state of the engine.

10. A trouble-detection apparatus for an EGR System of an internal combustion engine, comprising an EGR passage for communicating an exhaust passage of the internal combustion engine with an intake passage thereof and an EGR control valve for controlling a flow rate exhaust-gas recirculating through the EGR passage, wherein the EGR control valve is controlled by a negative pressure so that the negative pressure supplied to the EGR control valve is controlled in a feedback manner in accordance with a lift amount of the EGR control valve detected by a lift sensor and the operation state of the engine, wherein the apparatus comprises:

lift amplitude-detection means for detecting an amplitude of the detected value issued from the lift sensor;

pulse calculation means for calculating pulses in an exhaust-gas flow passing through the EGR control valve based on the detected amplitude of the pulses in the exhaust-gas flow; and clogging-detection means for detecting clogging in the EGR passage in accordance with the calculated amplitude of the pulses in the exhaust-gas flow and the operation state of the internal combustion engine.

11. A trouble-detection apparatus for an EGR system as defined by claim 10, wherein the pulse calculation means comprises a high-pass filter for extracting solely a higher frequency component from data detected by the lift sensor, and a peak hold circuit connected to an output of the high-pass filter.

12. A trouble-detection apparatus for an EGR system as defined by claim 11, wherein the clogging-detection means determines that the clogging has occurred in the EGR passage when the amplitude of the pulses in the exhaust-gas flow is smaller than a preset amplitude corresponding to the normal operating state of the engine.

13. A trouble-detection apparatus for an EGR system as defined by claim 12, further comprising:

first EGR control valve abnormality determination means for determining that the EGR control valve has an overlift abnormality when the lift amount detected by the lift sensor exceeds a maximum target value; and second EGR control valve abnormality determination means for determining that the EGR control valve has an underlift abnormality when the lift amount detected by the lift sensor is lower than a minimum target value.

14. A trouble-detection apparatus for an EGR system as defined by claim 13, wherein the clogging-detection means determines that the clogging has occurred in the EGR passage when the lift amplitude is smaller than a preset amplitude corresponding to the normal operating state of the engine.

* * * * *

UNITED STATES PATENT AND TRADEMARK OFFICE

CERTIFICATE OF CORRECTION

PATENT NO. : 5,664,548

DATED : September 9, 1997

INVENTOR(S) : Takahide IZUTANI, et al.

It is certified that error appears in the above-indentified patent and that said Letters Patent is hereby corrected as shown below:

ABSTRACT, line 16 , change "as" to --has--.

Column 1, line 9, delete "clogging" at beginning of line.

Column 1, line 26, change "is a" to --is, a--.

Column 1, line 37, after "apparatus" insert --for--.

Column 2, line 24, change "in" to --of--.

Column 2, line 32, change "preferably" to --Preferably--.

Column 3, line 48, change "close" to --closed--.

Column 4, line 44, changed "exhausted-gas" to --exhaust-gas--.

Column 5, line 18, change "tow-away" to --two-way--.

Column 5, line 37, after "signal" delete the comma.

Column 6, line 43, after "that" insert --show--.

Column 7, line 46, after "equal" insert --to--.

Column 7, line 49, after "207" insert a comma.

UNITED STATES PATENT AND TRADEMARK OFFICE

CERTIFICATE OF CORRECTION

PATENT NO. : 5,664,548

DATED : September 9, 1997

INVENTOR(S) : Takahide IZUTANI, et al.

It is certified that error appears in the above-indentified patent and that said Letters Patent is hereby corrected as shown below:

Column 7, line 63, after "shape" insert --of--.

Column 9, line 19, change "exhausted-gas" to --exhaust-gas--.

Column 9, line 22, change "exhausted-gas" to --exhaust-gas--.

Column 11, line 16, after "shape" insert --of--.

Column 11, line 23, change "inopeartive" to --inoperative--.

Column 11, line 42, delete the comma after "passage".

Column 12, line 61, after "hand," insert --if--.

Column 14, line 33, change "detection-means" to --detection menas--.

Column 14, line 55, after "engine," insert --wherein--.

UNITED STATES PATENT AND TRADEMARK OFFICE

CERTIFICATE OF CORRECTION

PATENT NO. : 5,664,548

DATED : September 9, 1997

INVENTOR(S) : Takahide IZUTANI, et al.

It is certified that error appears in the above-indentified patent and that said Letters Patent is hereby corrected as shown below:

Column 15, line 11, change "System" to --system--.

Column 15, line 15, after "rate" insert --of--.

Signed and Sealed this

Thirtieth Day of June, 1998

*Attest:*

*Attesting Officer*

Bruce Lehman

BRUCE LEHMAN

*Commissioner of Patents and Trademarks*